US011680405B2

(12) United States Patent
Poutanen

(10) Patent No.: US 11,680,405 B2
(45) Date of Patent: Jun. 20, 2023

(54) GLUED TIMBER TRUSS

(71) Applicant: PATENTTITOIMISTO T. POUTANEN OY, Tampere (FI)

(72) Inventor: Tuomo Poutanen, Tampere (FI)

( * ) Notice: Subject to any disclaimer, the term of this patent is extended or adjusted under 35 U.S.C. 154(b) by 0 days.

(21) Appl. No.: 15/503,337

(22) PCT Filed: Aug. 10, 2015

(86) PCT No.: PCT/FI2015/000034
§ 371 (c)(1),
(2) Date: Feb. 10, 2017

(87) PCT Pub. No.: WO2016/024040
PCT Pub. Date: Feb. 18, 2016

(65) Prior Publication Data

US 2017/0234011 A1 Aug. 17, 2017

(30) Foreign Application Priority Data

Aug. 11, 2014 (FI) ..... 20140217

(51) Int. Cl.
*E04C 3/16* (2006.01)
*E04C 3/02* (2006.01)
*E04C 3/12* (2006.01)

(52) U.S. Cl.
CPC ..... *E04C 3/16* (2013.01); *E04C 3/02* (2013.01); *E04C 3/122* (2013.01)

(58) Field of Classification Search
CPC ... E04C 3/02; E04C 3/12; E04C 3/122; E04C 3/16
USPC ..... 52/837, 847, 690, 693, 695
See application file for complete search history.

(56) References Cited

U.S. PATENT DOCUMENTS 2,455,217 A * 11/1948 Borges ..... E04C 3/16 52/695
2,780,842 A * 2/1957 Hess ..... E04C 3/16 52/693
3,452,502 A * 7/1969 Price ..... E04C 3/16 52/693
3,490,188 A * 1/1970 Troutner ..... E04C 3/12 52/690
3,507,524 A * 4/1970 Steidle-Sailer ..... F16B 12/46 403/219

(Continued)

FOREIGN PATENT DOCUMENTS

CA 2008043 7/1991
CA 2335684 8/2002

(Continued)

OTHER PUBLICATIONS

Machine translation of JP2014-55406, Jun. 25, 2017.*

(Continued)

*Primary Examiner* — Ryan D Kwiecinski
(74) *Attorney, Agent, or Firm* — B. Aaron Schulman, Esq.; Stites & Harbison, PLLC

(57) ABSTRACT

A glued timber truss (FIGS. 1, 3), comprising chords (1, 2) and therebetween a first diagonal bar (3) and a second diagonal bar (4), which is crosswise relative to the first one, or a web panel (9) connected to each other with an adhesive and a finger joint (FIG. 3), whereby the first diagonal bar is present alongside the second diagonal bar or the web panel.

3 Claims, 3 Drawing Sheets

(56) References Cited

U.S. PATENT DOCUMENTS

| | | | | | |
|---|---|---|---|---|---|
| 3,702,050 | A * | 11/1972 | Price | E04C 3/16 | 52/693 |
| 3,991,535 | A * | 11/1976 | Keller | E04C 3/127 | 52/642 |
| 4,074,498 | A * | 2/1978 | Keller | E04C 3/14 | 52/690 |
| 4,630,424 | A * | 12/1986 | Eberle | F16B 15/0046 | 52/693 |
| 5,560,177 | A * | 10/1996 | Brightwell | E04C 3/16 | 52/693 |
| 5,664,393 | A * | 9/1997 | Veilleux | E04C 3/16 | 52/693 |
| 5,966,894 | A * | 10/1999 | Crump, Jr. | E04C 3/14 | 52/404.3 |
| 7,185,471 | B2 * | 3/2007 | Schmerber | E04C 3/16 | 156/331.7 |
| 7,975,736 | B2 * | 7/2011 | Poutanen | E04B 1/2604 | 403/364 |
| 8,122,676 | B2 * | 2/2012 | Lemyre | E04C 3/14 | 52/696 |
| 8,424,577 | B2 | 4/2013 | Poutanen | | |
| 8,919,071 | B2 * | 12/2014 | Vanker | E04C 3/08 | 52/693 |
| 2002/0007611 | A1 * | 1/2002 | Sanford | E04C 3/16 | 52/694 |
| 2002/0040560 | A1 * | 4/2002 | Kent | E04C 3/16 | 52/634 |
| 2002/0148192 | A1 * | 10/2002 | Veilleux | E04C 3/16 | 52/693 |
| 2002/0148193 | A1 * | 10/2002 | Veilleux | E04C 3/16 | 52/693 |
| 2003/0061780 | A1 * | 4/2003 | Masterson | E04C 3/08 | 52/693 |
| 2005/0225172 | A1 | 10/2005 | Brightwell | | |
| 2008/0092988 | A1 * | 4/2008 | Poutanen | B27F 1/16 | 403/364 |
| 2008/0121312 | A1 | 5/2008 | Poutanen | | |
| 2008/0250747 | A1 * | 10/2008 | Johnson | E04C 3/16 | 52/693 |
| 2009/0094930 | A1 * | 4/2009 | Schwoerer | E04C 3/16 | 52/693 |
| 2010/0061829 | A1 | 3/2010 | Mcadoo et al. | | |
| 2010/0205892 | A1 * | 8/2010 | Lemyre | E04C 3/18 | 52/693 |
| 2010/0263319 | A1 * | 10/2010 | Lemyre | E04C 3/14 | 52/693 |
| 2015/0267407 | A1 * | 9/2015 | Sirowatka | E04C 3/16 | 52/690 |
| 2017/0016229 | A1 * | 1/2017 | Cossette | E04C 3/16 | |
| 2017/0058525 | A1 * | 3/2017 | Hercus | E04C 3/16 | |

FOREIGN PATENT DOCUMENTS

| | | | | |
|---|---|---|---|---|
| CA | 2654720 | | 5/2009 | |
| CH | 306573 | | 4/1955 | |
| CH | 517 876 | | 1/1972 | |
| CH | 517876 | | 1/1972 | |
| CH | 542969 | A * | 11/1973 | E04C 3/14 |
| CH | 544199 | A * | 11/1973 | E04G 11/50 |
| CH | 550908 | A * | 6/1974 | B27M 3/0026 |
| CH | 640591 | A5 * | 1/1984 | E04C 3/18 |
| DE | 2242329 | A1 * | 3/1974 | |
| DE | 2242329 | A1 * | 3/1974 | E04C 3/16 |
| FI | 118153 | | 7/2007 | |
| FR | 2058315 | | 5/1971 | |
| FR | 2185735 | A2 * | 1/1974 | E04G 11/50 |
| FR | 2718175 | A1 * | 10/1995 | E04C 3/16 |
| GB | 2038393 | | 7/1980 | |
| GB | 2038393 | A * | 7/1980 | E04C 3/16 |
| JP | 2014-055406 | | 3/2014 | |
| JP | 2014055406 | | 3/2014 | |
| JP | 2014055406 | A * | 3/2014 | |
| WO | WO-2009156559 | | 12/2009 | |
| WO | WO-2010066783 | A2 * | 6/2010 | E04C 3/12 |
| WO | WO-2010/118531 | | 10/2010 | |
| WO | WO-2014053905 | | 4/2014 | |

OTHER PUBLICATIONS

Machine translation of DE 2 242 329, Jun. 25, 2017.*

Machine Translation of DE 2 242 329 to Dehne; https://translationportal.epo.org; Dec. 20, 2019 (Year: 2019).*

Machine Translation JP 20140554406A, Foreign Patent Finder; https://dialog.proquest.com/professional/cv_2183530/docview/1512079054/1778EFD146024FDB4B8/8?accountid=131444 (Year: 2021).*

DE22423292 Machine Translation; https://translationportal.epo.org/emtp/translate/?ACTION=description-retrieval&COUNTRY=DE&ENGINE=google&FORMAT=docdb&KIND=A1&LOCALE=en_EP&NUMBER=2242329&SRCLANG=de&TRGLANG=en; Jun. 1, 2022 (Year: 2022).*

International Search Report for PCT/FI2015/000034, dated Dec. 9, 2015.

Written Opinion for PCT/FI2015/000034, completed Dec. 7, 2015.

First Office Action and Search Report for FI 20140217, dated Mar. 31, 2015.

Notification of Transmittal of the International Search Report and the Written Opinion of the International Searching Authority, or the Declaration, dated Dec. 9, 2015.

"Einsatzmöglichkeiten der DSB-Trager", Mar. 15, 1993.

Extended European Search Report dated Mar. 6, 2018 in corresponding European Application No. 15831775.0.

Communication dated Mar. 23, 2018 in corresponding European Application No. 15831775.0.

Extended European Search Report dated Feb. 2, 2020 in corresponding European Application No. 19206754.4.

Notice of Intention to Grant dated Apr. 8, 2021 in European Application No. 19 206 754.4.

* cited by examiner

GLUED TIMBER TRUSS

BACKGROUND OF THE INVENTION

This invention relates to a glued timber truss, to a joint and a manufacturing method for the same. Such trusses are widely used in the lower, intermediate and upper floors of buildings. The invention relates specifically to truss beams for sub-, intermediate and top floorings with parallel chords, but also to roof trusses with diverging or arched chords.

REFERENCE TO THE ART AND PUBLICATIONS

At the moment, timber trusses are made more or less exclusively with metal connectors, especially metal plates.

The glued truss provides numerous advantages over trusses manufactured with metal joints, such as: inexpensiveness, fire resistance, moisture resistance, rigidity and visual appearance, which is why glued trusses show great potential. The problem is that earlier there has not been available a sufficiently robust, reliable and what in terms of spacing and shoring would be flexible timber truss joint. This disclosure describes new solutions based on glued trusses, which eliminate the essential problems of prior solutions and enable the use of glued timber trusses in demanding construction projects.

SUMMARY OF THE INVENTION

The truss according to the invention comprises chords, i.e. bars spaced from each other, and diagonals present therebetween. Each diagonal may consist of several substantially co-directional bars. The novel truss is reliably sturdy and applicable to all types of permanent and temporary construction projects. The novel truss is particularly applicable to light and heavy duty trusses constructed from sawn timber, LVL, or other similar material. The chords are generally lying flat (diagonals joining the larger cross-sectional surface), but sometimes on the side (diagonals joining the smaller cross-sectional surface). This invention involves applications of certain new solutions and new combinations of prior known solutions:

- The number of fingers is typically not more than two. In special cases, such as heavy duty trusses and fireproof trusses, the number of fingers can be more.
- Fingers are embedded deep in a chord, at least to about halfway across the chord and generally almost all the way to the opposite surface. The finger may include an inside finger, which is particularly effective, most of the diagonal-chord engagement surface being thereby located optimally, i.e. along the edges of a joint area and mostly deep inside the chord.
- At least one finger of the joint is tapering at least in its tip portion, resulting in several benefits. The joint if easy to assemble, the joint becomes wedged effectively and the truss is capable of enduring movements prior to curing of the glue and the joint weakens the chord just a little, because chord routing is slight.
- The joint can be routed entirely or at least partially with a bit that only cuts with its outer rim, i.e. with a sawblade type of bit. Such a bit is inexpensive, its sharpening is easy, routing speed can be high and routing result good in defective and knotty timber as the wood does not cleave and knots do not dislodge in routing.

- The joint's diagonal bar is broad and narrow, having generally a larger cross-sectional ratio of at least about 6. In current solutions, the cross-sectional ratio is about 1-4. In this solution, it is a specific necessity that the diagonal bar be broad as each diagonal bar generally includes its own chord groove. If the diagonal width is small, such a diagonal bar cannot be worked with a rotary tool for a routed groove sufficiently deep for the chord.
- The diagonal bar is thin, generally not more than 16 mm. In current solutions, the diagonal bar is at least about 25 mm. As the diagonal bar is thin, there can be at least three diagonal bars side by side even if the chord thickness were a chord thickness generally employed in timber trusses, i.e. about 40 mm (38-48 mm). In case the truss height is more than about 400 mm, the compression bars at least will be thicker than 16 mm.
- At locations requiring a high strength, especially at truss ends, a single diagonal includes several bars either in parallel or in succession, especially the critical tension diagonals being adapted to include several bars.
- The length of a finger groove in a chord is large, about 100-200 mm per one diagonal bar, in current solutions generally 60-80 mm. What is achieved with such a solution is that the diagonal-chord joint area is large, yet the chord routing severs the grains of a chord bar just a little, i.e. weakens the chord just slightly, less than in any other known solution.
- The stresses are adapted to extend from one diagonal bar of the joint to the chord and further from the chord to a second diagonal bar without spacer blocks and without a mutual structural joint between the bars in assembly and in a completed truss. Each diagonal bar of the truss has generally its own chord groove at a varying distance. This distance can also be negative, i.e. the diagonals are adjacent or at least partially notched to each other. In currently available joints, the diagonal bars are connected to each other in a common chord groove with a finger or butt joint.
- The diameter of a router bit is small at least in chord routing, generally smaller than about 120 mm and most preferably smaller than 90 mm. In this solution, it is of particular importance that the router bit is small in diameter, since each diagonal bar has generally its own routed groove on the chord. In currently available solutions, the diameter is generally larger than about 150 mm. A small bit can be used for working a routed groove which is large in terms of its gluing area.
- Diagonal bars are not attached to each other in the joint, but can be at a distance from each other. This distance can be set as desired according to diagonal spacing, an opening or a beam. The openings and struts of a truss apply to additional stresses to the truss, but in this solution the edges of openings can be provided with a necessary number of additional bars. In currently available solutions, the diagonal bars are connected to each other in a joint, whereby the crosswise openings are small and can only be constructed in the middle of a truss, because the truss cannot be strengthened at the openings.
- Diagonal bars are arranged at least partially in parallel or in succession either co-directionally or in different directions. This solution provides several benefits: The truss can be strengthened e.g. between node points by adding an extra bar. The diagonal spacing can be changed and the truss can be reinforced with extra diagonals, whereby the opening across a truss, required for a beam, a pipe or the like, can be located anywhere in the truss, even near the support, which is not possible in current solutions.

The joints are capable of being constructed in a simple manner with few tools and work cycles. A particularly preferred option is such that the number of router tools is two, one for a chord and the other for a diagonal bar, the number of work cycles both on the chord and on the diagonal bar is just one, and the router tool moves relative to a workpiece (or, alternatively, the piece moves relative to the router tool) in two directions only. In currently available solutions, the number of work cycles is generally for diagonal bars and one or two for a chord and the working tool travels relative to a workpiece at least in two directions, but occasionally in more directions. Another noteworthy option is to conduct all routing operations with a sawblade type which only uses its outer rim for cutting.

The truss ends can be easily provided with a high strength by means of parallel and/or successive diagonal bars and the truss can be supported from a top chord, which is not possible in current glued trusses without special reinforcements.

In currently available truss joints, the diagonal bars in a chord groove are in abuttal, being thereby self-positioning upon pressing the chords against each other, whereby the positioning of diagonal bars in an assembly jig is not necessary. On the other hand, the joints of this truss are not self-positioning, nor do the diagonal bars have a mutual finger or butt joint. The novel truss is manufactured in such a way that the chords are placed in their final positions and the diagonal bars are pressed to the chords into their final positions with an automated device, for example a robot. What is achieved with such a solution is that the diagonal bars need have no positioning in an assembly jig. This aspect is of major importance, because the locations of diagonals vary in different trusses.

The truss is reliably durable and need not be load tested. This is achieved in such a way that at least a single tension diagonal at an end of the truss comprises at least two bars. The currently available glued trusses must be load tested, which is expensive.

The truss is torsionally rigid, which is achieved in such a way that at least a single diagonal at both ends of the truss comprises two bars side by side. What is essential from the standpoint of cost efficiency is that the bars are only parallel at the truss ends only. Torsional rigidity enables the truss to be placed in an inclined position as well, for example on the slope of a pitched roof co-directionally with the ridge.

BRIEF DESCRIPTION OF THE DRAWINGS

FIG. 4 shows a joint which is easy to work on.

DETAILED DESCRIPTION OF THE INVENTION WITH REFERENCE TO THE FIGURES

Figure 1:
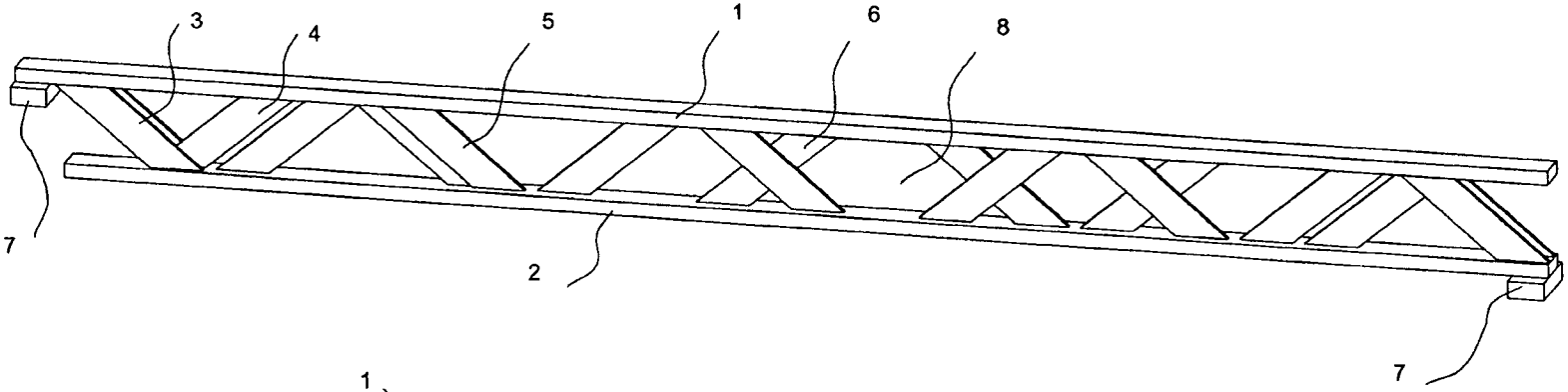
FIG. 1 shows a truss beam.

FIG. 1 shows a truss beam, comprising a top chord 1, a bottom chord 2, diagonal bars 3, 4, 5 and 6, and supports 7. The diagonal 3 at the left hand end consists of two parallel bars. The next diagonal 4 also features two bars, but in succession. What is achieved with such a solution is that both diagonals are sound and the joint's eccentricity is slight or nonexistent. The diagonal 5 also consists of two bars both in parallel and partly in succession. This demonstrates that the truss can have bars more or less in any location where needed for the reason of e.g. joint eccentricity, buckling, spacing, intermediate bracing, fire resistance or the like. At the truss ends, one of the chords is unsupported. If needed for one reason or another, the support can be provided by having at the truss end a bar similar to that of the diagonal 4, whereby the entire truss can be constructed with just one type of diagonal bar. The necessity of having a vertical bar at the truss end entails extra work. It is the premise that all bars are identical and installed with a robot or the like in a jig so as to place the diagonal bars in final positions without guide means. When the finger routing of a vertical bar present at the end is conducted in such a way that the length of a finger increases towards the end, the truss end may have a vertical bar which can be set in its position even with the chords in an installation jig at their final locations. Another notable option is that the truss chords shall not be fitted in their final positions in the assembly until after the installation of end-placed vertical bars and other possible vertical bars. Another aspect demonstrated by this figure is that the truss has at least two and generally also three bars in parallel. As the edge of a truss chord, according to building standards, is often 38-45 mm and the chord may also lie on its edge, the thickness of a diagonal bar shall not be more than about 16 mm. The truss can be robust, its strength and rigidity being infinitely increasable by increasing chords and diagonals, whereby the truss of the invention is also suitable for use as a heavy duty beam which is less expensive than and capable of replacing a massive beam such as a glulam beam. The chord can be broad and the diagonal bars can be disposed at the edges of the chords so as to leave space in the middle part of a truss for pipes, wires, or the like. The chords can also be arched. A particularly favorable solution is that the chords are circular arcs, whereby all diagonal bars can be identical. If necessary, the side-by-side chords, either co-directional or diverging, can be connected to each other because of buckling, fire resistance, or the like reason. The diagonal bars are in a joint at a distance from each other and this distance is smaller at truss ends than in the middle. This reduces manufacturing and material costs, and in the middle part of a truss, in each node interval, develops a large transverse opening. In terms of durability, the truss is more or less symmetrical and can also be turned over.

Figure 2:
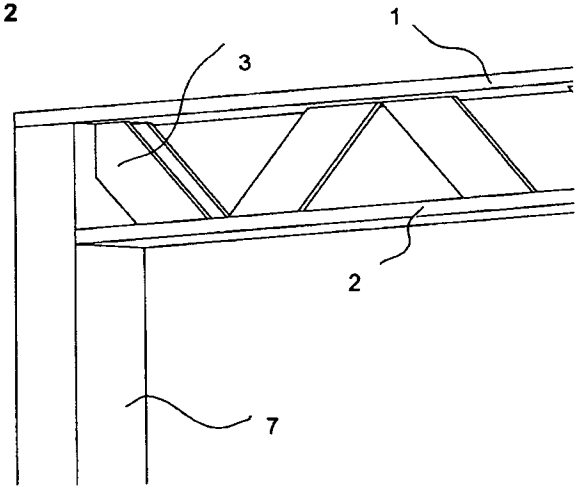
FIG. 2 shows a truss beam end and joint with a column.

FIG. 2 shows a truss end, including a column 7 and a diagonal 3 extending to the support and comprising two bars. These have been notched to the column and fastened thereto preferably with screws or the like. Such a joint is reliable, visually attractive, and easy to construct on site. An alternative solution is that on top of the column or support is a pedestal and the diagonals are notched thereto or the diagonal is provided with a notch.

Figure 3:
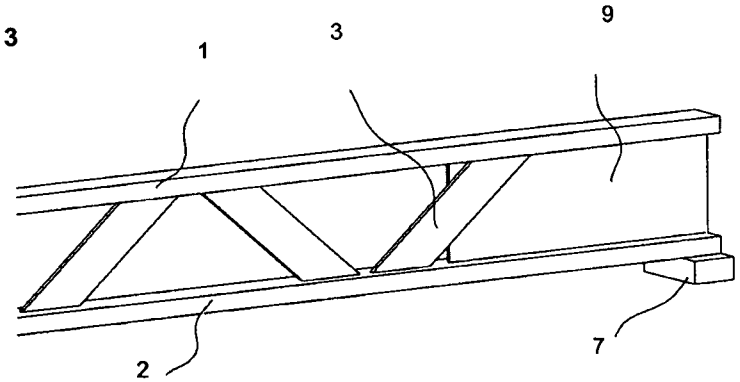
FIG. 3 shows a truss beam end with a web panel.

FIG. 3 shows a truss end, including a web panel 9 such as an OSB panel, plywood, or the like. The diagonal bar 3 is fitted alongside the panel, whereby the joint is easy to carry out in automated production. There may also be several panels and diagonal bars, in which case the truss can be connected to a column or to another similar truss by overlapping the web panels and by nailing the same to each other when the chords to not extend all the way to the panel's end. When a truss is attached this way to another truss, these trusses can be at an angle relative to each other, for example such that one truss is a beam and the other is a column.

Figure 4:
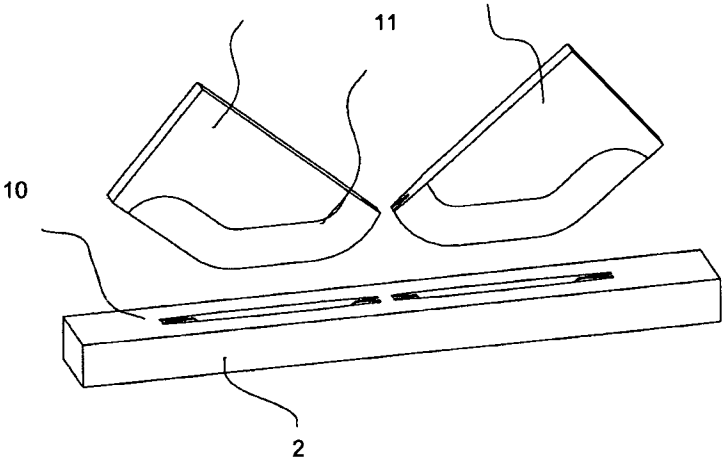

FIG. 4 shows a joint, including a chord 2 and diagonal bars 3 and 4. The joint has one finger most preferably tapering towards the tip, and therein an inside finger 10 which also, most preferably, tapers towards the tip. Such a finger can be machined on a diagonal bar with a single machining operation in such a way that the tool is only guided in two directions, in the direction of a chord and in the direction perpendicular thereto, such that the edge of machining is in the diagonal bar consistent with a curve 11. Such a joint is strong, because the inside finger establishes a robust joint at locations significant from the standpoint of overall strength, i.e. at the base of a chord and at the ends of a joint area. If the diagonal bars are thin, or if the chord is in the form of a panel, such as an OSB, plywood, or the like panel, there will be no inside finger.

Figure 5:
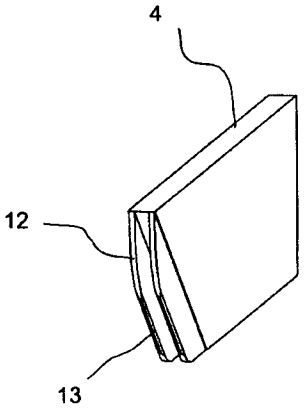
FIG. 5 shows a diagonal bar end.

FIG. 5 shows an end of the diagonal bar 4. The fingers have been routed in two operations. Tips of the fingers have been shaped with a finger bit, a bandsaw or the like, and for example with a sawblade type of bit moving in one direction and cutting the actual fingers with its outer rim. This type of machining is relatively fast, because there are just two working operations and the bit, cutting with its outer rim, does not damage the finger in case it has defects such as knots. What is essential in any case is that the finger tips are provided in one and the same working operation with chamfers 13, which are essential in the installation of a diagonal bar. In addition, the chamfers are beneficial from the standpoint of adhesive application by providing the completed joint with a pocket for excess glue. The chamfers also promote a uniform distribution of the glue.

Figure 6:
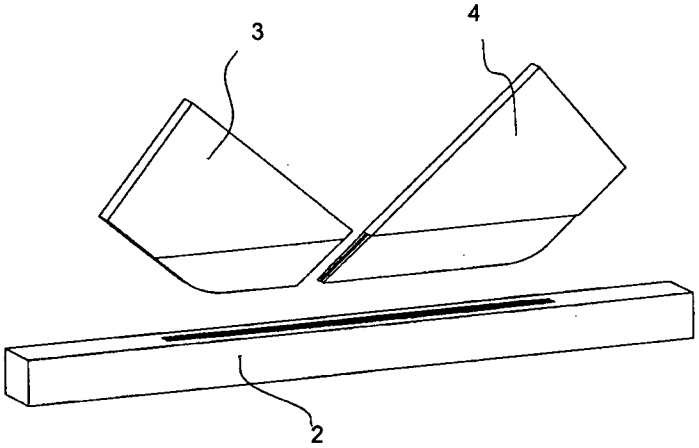
FIG. 6 shows an asymmetric cost-effective joint.

FIG. 6 shows a joint, including a chord 2 and diagonal bars 3 and 4. The joint is asymmetrical in such a way that the bar 4 has a larger engagement area. Asymmetry complicates manufacturing of the truss as the advantage gained by identical bars is lost in an asymmetric joint. On the other hand, in such a joint, the wastage caused by the routing of diagonal bars is slight and the material cost of a truss is low. An important application is to replace the bar 3 with a type of bar similar to the bar 4. In that case, the joint is symmetrical with large engagement areas. An essential aspect in the assembly of a joint consistent with this figure is that the chords have been positioned at final locations and that the bars are pressed to the chords most preferably with an automated device such as a robot. At present, the trusses are manufactured in such a way that the bars are pressed to a final position by pressing the chords towards each other, which is not possible in this type of joint as the diagonal bars do not have a butt joint. By virtue of good material efficiency and strength, such a joint is highly useful for truss ends in such a way that the bar 4 is a first tension bar of the truss. A particularly favorable solution is such that, at the end of a truss, the joints are consistent with this figure in such a way that the bar 4 is adapted as a tension bar and that, in the middle part joints of the truss, the diagonal bars are located at a distance from each other. A particularly favorable solution is also such that the truss is supported from the top chord and the bar 4 is a bar commencing from the top chord and the bar has its tip fitted at least partially on top of the support.

Figure 7:
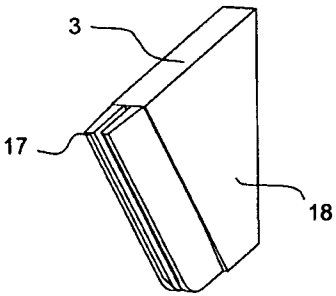
FIG. 7 shows a diagonal bar end.

FIG. 7 shows an end of the diagonal bar 4 presented in FIG. 6. In the middle is a straight finger groove, which has been routed with a sawblade type bit, which performs cutting only with an outer rim. The fingers are tapering towards the tip. The external sides of fingers have been routed with a cylinder type bit so as to enable the making of a chord groove with a rotating bit which only moves in two directions. Although the machining of a diagonal finger involves several operations, the joint is visually pleasant as well as strong, and the chord groove machining is easy. A noteworthy option is that there is no finger groove in the middle and that just one side of the diagonal bar is routed, resulting in a particularly high-speed machining of the finger. In the routing of fingers, it is wood defects, such as knots, which constitute a major problem. Therefore, it is preferred that as many of the fingers as possible, particularly the middle fingers, be routed with a sawblade type of bit.

Figure 8:
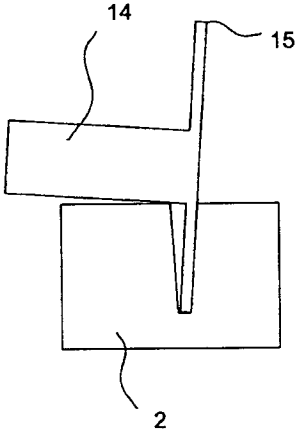
FIG. 8 shows a cutting bit in a chord.

FIG. 8 shows the way of routing a chord finger with a rotary tool 14 which has a cutting bit 15 on its outer rim. The chord finger is tapering such that the finger tip is about a half of the base, and it is machined in two operations such that each of the sides is machined separately by tilting the bit to match the sides. Alternatively, one side of the finger is machined in some other manner. Such a tool is inexpensive and the machined groove is good even if the timber had defects such as knots. The complementary diagonal finger is made in a similar manner, preferably such that there are bits in succession at various angles, resulting in high-speed machining.

Figure 9:
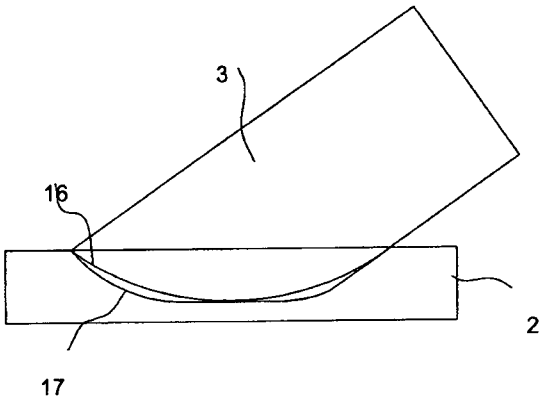
FIG. 9 shows a groove in a chord for large and small cutting bit.

FIG. 9 shows a diagonal 3 and a chord 2. A curve 16 represents the groove of a large-diameter tool and a curve 17 the groove of a small tool. The figure shows that a currently employed large tool, at least 150 mm in diameter, can be used for making a reasonably shallow machined groove and the chord-diagonal joint surface will be small. With a small tool, not more than about 120 mm, and most preferably not more than about 90 mm in diameter, can be made a deep groove, resulting in a large joint area and also high strength. It can also be seen from this figure that this diagonal 3 according to the invention must have a large width.

The invention claimed is:

1. A glued timber truss comprising a top chord, a bottom chord, two truss ends, and between the truss ends there are a plurality of ascending and descending elongated webs between the top chord and bottom chord and adhesively connected to said chords;

wherein lower ends of said webs are fixed in the bottom chord, and upper ends of said webs are fixed in the top chord;

wherein the truss has at least one crosswise opening having a height that is a distance between a lower face of the top chord and an upper face of the bottom chord, and;

wherein on at least one side of said opening along the length of the truss, the webs are arranged to make an X-pattern.

2. The glued timber truss according to claim 1, wherein the webs are arranged to make an X-pattern at both sides of the opening along the length of the truss.

3. The glued timber truss according to claim 1, wherein an upper side of the opening comprises a lower face of the top chord, and a lower side of the opening comprises an upper face of the bottom chord.

* * * * *